US006780020B2

(12) United States Patent
Kondo et al.

(10) Patent No.: US 6,780,020 B2
(45) Date of Patent: Aug. 24, 2004

(54) STRUCTURE FOR CONNECTING INSTRUMENT PANEL-SIDE CONNECTOR AND VEHICLE BODY-SIDE CONNECTOR

(75) Inventors: Masayuki Kondo, Toyota (JP); Haruhiko Sato, Toyota (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/265,780

(22) Filed: Oct. 8, 2002

(65) Prior Publication Data

US 2003/0071473 A1 Apr. 17, 2003

(30) Foreign Application Priority Data

Oct. 15, 2001 (JP) ..... P2001-316798

(51) Int. Cl.[7] ..... H01R 33/00
(52) U.S. Cl. ..... 439/34
(58) Field of Search ..... 439/34, 36, 94, 439/109, 114, 116

(56) References Cited

U.S. PATENT DOCUMENTS 4,942,499 A * 7/1990 Shibata et al. ..... 361/826
5,915,978 A * 6/1999 Hayakawa et al. ..... 439/76.2
6,062,888 A * 5/2000 Takiguchi ..... 439/248
6,352,433 B2 * 3/2002 Hayashi ..... 439/34
6,364,670 B1 * 4/2002 Wickett et al. ..... 439/76.2

FOREIGN PATENT DOCUMENTS

| | | |
|---|---|---|
| JP | 10-92522 | 4/1998 |
| JP | 10-129299 | 5/1998 |
| JP | 10-310002 | 11/1998 |
| JP | 2000-150062 A | 5/2000 |
| JP | 2001-150979 A | 6/2001 |
| WO | WO 99/65718 A2 | 12/1999 |

* cited by examiner

*Primary Examiner*—Tho D. Ta
*Assistant Examiner*—James R. Harvey
(74) *Attorney, Agent, or Firm*—Sughrue Mion, PLLC

(57) ABSTRACT

An instrument panel of a vehicle is attached on a reinforce which is fixed on a part of a vehicle body. A first connector is provided on at least one of both longitudinal end portions of the reinforce. The first connector is electrically connected to electric equipments provided with the instrument panel. A second connector is provided on the vehicle body such that electric connection is effected with the first connectors when the reinforce is fixed on the vehicle body.

5 Claims, 3 Drawing Sheets

STRUCTURE FOR CONNECTING INSTRUMENT PANEL-SIDE CONNECTOR AND VEHICLE BODY-SIDE CONNECTOR

BACKGROUND OF THE INVENTION

This invention relates to a structure for connecting an instrument panel-side connector to a vehicle body-side connector, and more particularly to a connecting structure for connecting an panel-side harness, mounted on a reinforce, to a connector fixed to a vehicle body.

As shown in FIG. 3, a reinforce 65 for reinforcing purposes is mounted on an instrument panel 61 of a vehicle, and extends between right and left side walls 62 and 63 thereof. In addition, a wire harness 66 for connection to wire harnesses (mounted on a vehicle body) is mounted on and along the reinforce 65.

For mounting the instrument panel 61 and the reinforce 65 on the vehicle body (not shown), first, the reinforce 65 is mounted on the instrument panel 61 to form a module 60. Then, right and left end 65A and 65B of the reinforce 65 of this module 60 are fixedly secured to the vehicle body by bolts, thus mounting the module 60 on the vehicle body.

Then, when the vehicle body-side wire harnesses (not shown) are connected to the wire harness 66 on the reinforce 65, the operation for mounting the instrument panel 61 and the reinforce 65 on the vehicle body is completed.

However, when the right and left ends 65A and 65B of the reinforce 65 are to be secured to the vehicle body by the bolts, the right and left side walls 62 and 63 of the instrument panel 61 conceal the right and left ends 65A and 65B of the reinforce 65, respectively.

Therefore, in order to facilitate this mounting operation, it has been necessary to form holes (used for the bolting operation) respectively in the right and left side walls 62 and 63 of the instrument panel 61 or to divide the instrument panel 61 into two (upper and lower) sections. Thus, it has been necessary to form the working holes in the instrument panel 61 or to divide the instrument panel into the two (upper and lower) sections, and this has prevented the degree of freedom of the design from being enhanced.

In addition, after the right and left ends 65A and 65B of the reinforce 65 are secured to the vehicle body by the bolts, the wire harness 66 on the reinforce 65 need to be connected to the vehicle body-side wire harnesses, and therefore there has been encountered a problem that much time and labor are required for mounting the instrument panel 61 and the reinforce 65 on the vehicle body.

SUMMARY OF THE INVENTION

It is therefore an object of the invention to provide a structure for connecting an panel-side connector to a vehicle body-side connector, in which it is not necessary to form any working hole in an instrument panel and to divide the instrument panel into two sections, and the time and labor for connecting a wire harness on a reinforce to a vehicle body-side wire harness can be saved.

In order to achieve the above object, according to the present invention, there is provided an electric connection structure in a vehicle body, comprising:

a reinforce, on which an instrument panel of a vehicle is attached, the reinforce fixed on a part of the vehicle body;

a first connector, provided on at least one of both longitudinal end portions of the reinforce, the first connector electrically connected to electric equipments provided with the instrument panel; and a second connector, provided on the vehicle body such that electric connection is effected with the first connectors when the reinforce is fixed on the vehicle body.

In this structure, the first (panel-side) connector can be connected to the second (body-side) connector by merely mounting the reinforce on the vehicle body.

Preferably, one of the first connector and the second connector includes a self-alignment member with respect to the other.

In this structure, the panel-side connector can be more positively connected to the second body-side connector when the reinforce is fixed on the vehicle body.

Preferably, the second connector is a connector included in an electric junction box provided in the vehicle body.

In this structure, there is no need a wire harness extended from the electric junction box. Therefore, a space required for wiring such a wire harness can be omitted.

Here, it is preferable that the structure further comprises a bracket for fixing the electric junction box on the vehicle body. The bracket serves as a retaining member which retains the reinforce on the vehicle body.

In this structure, a space, in which such an additional fixing bracket is disposed, does not need to be provided.

Here, it is preferable that the reinforce is formed with a flange portion, and the bracket is formed with a groove which receives the flange portion when the reinforce is fixed on the vehicle body.

In this structure, the reinforce can be mounted on the vehicle body by merely fitting the flange portion of the reinforce into the groove in the bracket.

In view of the above, in contrast with the related-art structure, it is not necessary to form working holes in the instrument panel or to divide the instrument panel into two sections, so that the operation for mounting the reinforce on the vehicle body can be carried out more easily.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

One preferred embodiment of the present invention will now be described in detail with reference to the accompanying drawings.

Figure 1:
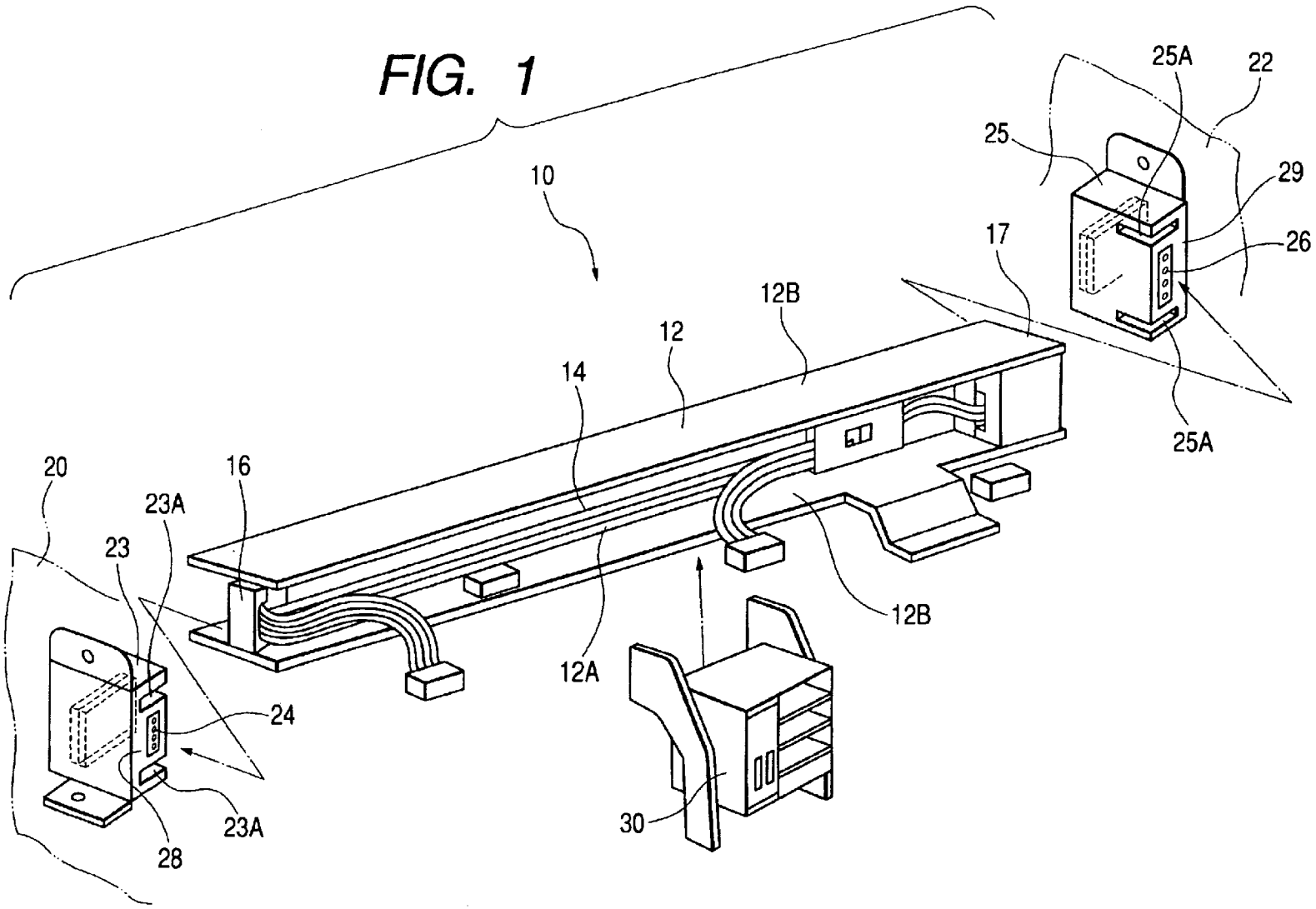
FIG. 1 is a perspective view of a reinforce forming a structure for connecting an panel-side connector to a vehicle body-side connector, according to one embodiment of the invention.

As shown in FIG. 1, a structure 10 of connecting panel-side connectors to body-side connectors comprises: an instrument panel (not shown) to be mounted at a front portion of a driving room of a vehicle; a reinforce 12 mounted on a reverse side of this instrument panel; an panel-side harness 14 mounted on and along the reinforce 12; panel-side connectors 16 and 17, which are connected to the panel-side harness 14, and are fixedly secured respectively to left and right ends of the reinforce 12; body-side connectors 24 and 26, which are fixedly secured respectively to both side portions 20 and 22 of the vehicle body so as to oppose to the respective panel-side connectors 16 and 17; and body-side wire harnesses (not shown) connected respectively to the body-side connectors 24 and 26.

Figure 2:
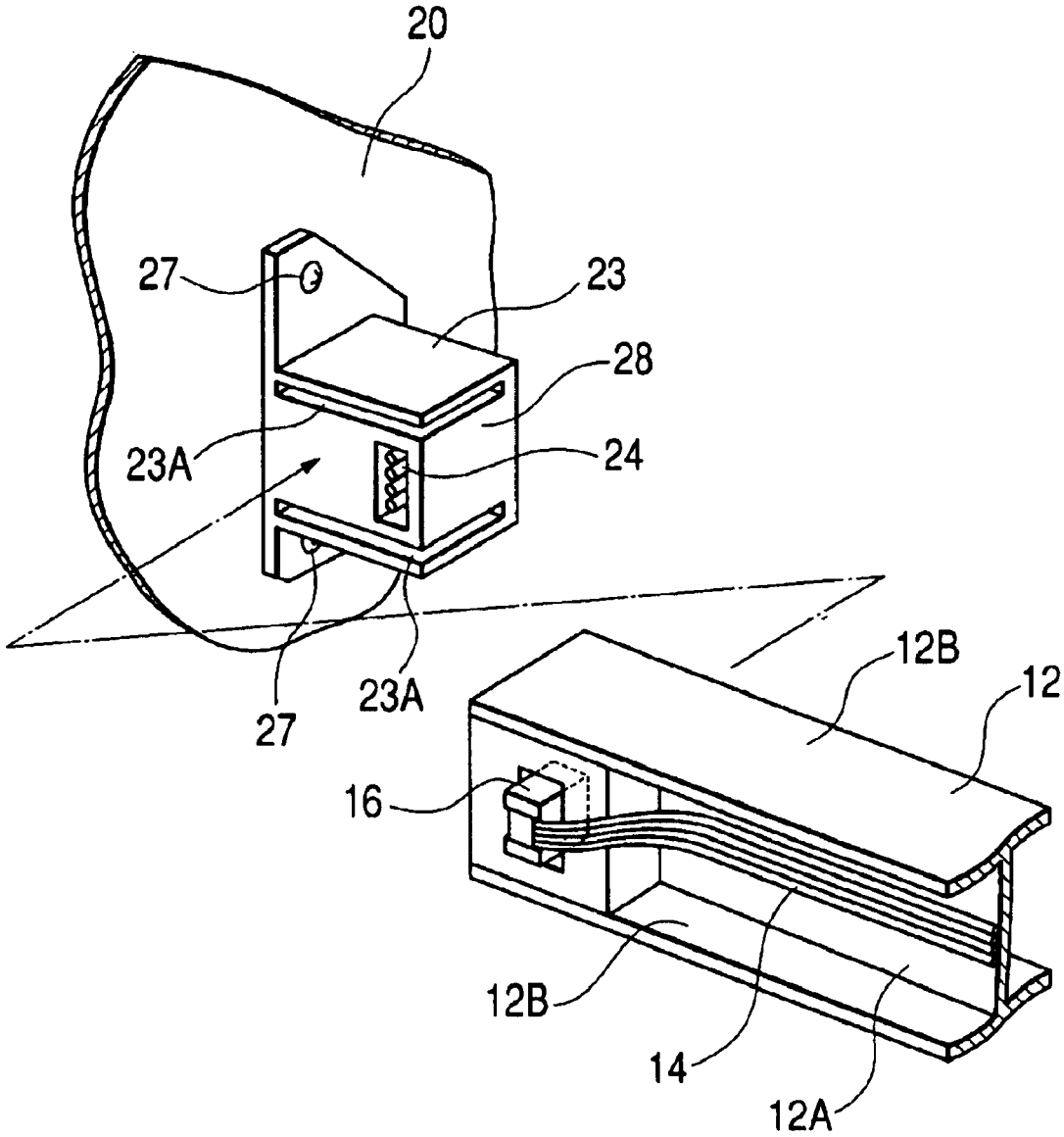
FIG. 2 is a perspective view of an essential portion of the structure shown in FIG. 1.
Figure 3:
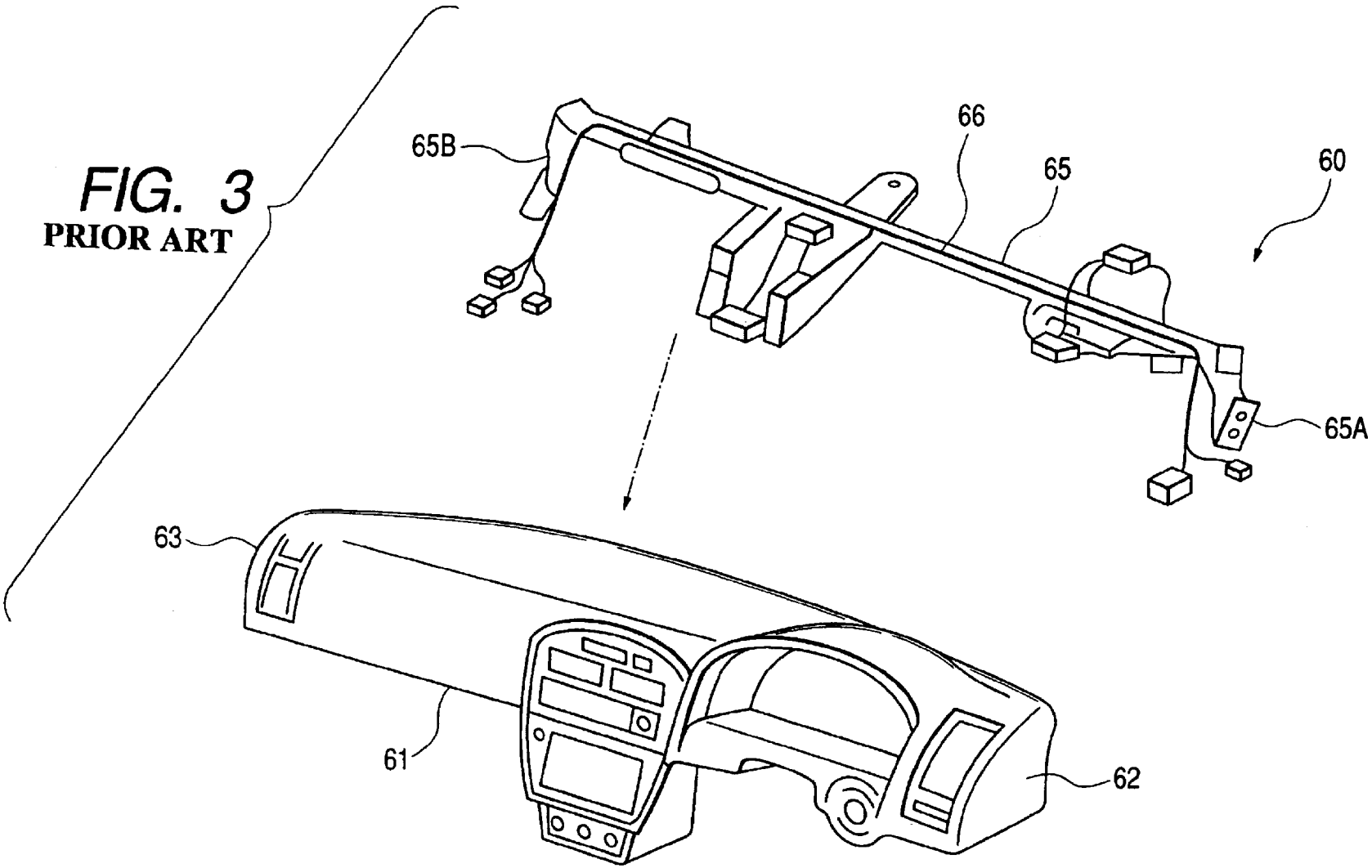
FIG. 3 PRIOR ART
FIG. 3 is an exploded, perspective view showing a related-art vehicle module structure.

As shown in FIGS. 1 and 2, the reinforce 12 is formed, for example, so as to have an H-shaped cross-section. The panel-side harness 14 (that is, a flat wire harness) is installed along a base portion 12A of the reinforce 12. Both ends of the panel-side harness 14 are connected respectively to the panel-side connectors 16 and 17.

An electrical equipment 30 such as a multi-media type electrical equipment is mounted on an almost central portion of the reinforce 12.

The body-side connectors 24 and 26 are mounted on fixing brackets 23 and 25, respectively. The fixing brackets 23 and 25 are fixedly secured respectively to the vehicle body portions 20 and 22 by bolts 27 (see FIG. 2) or the like.

Each of electric junction boxes 28 and 29 has a circuit-branching function and a control function achieved by an electronic circuit such as an ECU.

The vehicle body-side connectors 24 and 26 are connectors of the electric junction boxes 28 and 29, respectively. Therefore, it is not necessary to extend a wire harness from each of the electric junction boxes 28 and 29, and spaces, in which such wire harnesses, extending respectively from the electric junction boxes 28 and 29, are installed, respectively, do not need to be provided, and therefore a space-saving construction can be achieved.

The fixing brackets 23 and 25 of the electric junction boxes 28 and 29 serve also to retain the reinforce 12. Therefore, it is not necessary to provide additional fixing brackets for the reinforce 12. Therefore, spaces, in which such additional fixing brackets are disposed, respectively, do not need to be provided, so that a space-saving construction can be achieved.

Each of the fixing brackets 23 and 25 of the electric junction boxes 28 and 29 has fitting grooves 23A, 25A into which upper and lower horizontal walls 12B of the reinforce 12 can be fitted, respectively. When the horizontal walls 12B of the reinforce 12 are fitted respectively into the fitting grooves 23A, 25A in each of the fixing brackets 23, 25, the both ends of the reinforce 12 are fixed respectively to the fixing brackets 23 and 25 of the electric junction boxes 28 and 29.

Thus, merely by fitting the horizontal walls 12B of the reinforce 12 respectively into the fitting grooves 23A, 25A in each of the fixing brackets 23 and 25, the reinforce 12 can be mounted on the vehicle body portions 20 and 22. Therefore, the operation for mounting the reinforce 12 on the vehicle body can be easily carried out.

Next, the procedure of assembling the structure 10 will be described.

For mounting the instrument panel and the reinforce 12 on the vehicle body portions 20 and 22, first, the electrical equipment 30 is mounted on the reinforce 12, and the reinforce 12 in this condition is mounted on the instrument panel to form a vehicle module assembly.

Then, the fixing brackets 23 and 25 are fixedly secured respectively to the vehicle body portions 20 and 22 by the bolts 27 or the like. Then, the left ends of the horizontal walls 12B of the reinforce 12 of the module are fitted respectively into the fitting grooves 23A in the left fixing bracket 23 while the right ends of the horizontal walls 12B are fitted respectively into the fitting grooves 25A in the right fixing bracket 25. As a result, the both ends of the reinforce 12 are fixed respectively to the fixing brackets 23 and 25 of the electric junction boxes 28 and 29.

When the both ends of the reinforce 12 are thus fixed respectively to the fixing brackets 23 and 25, the panel-side connectors 16 and 17, mounted respectively at the both ends of the reinforce 12, are automatically connected to the body-side connectors 24 and 26, respectively.

Thus, the operation for mounting the instrument panel and the reinforce 12 on the vehicle body portions 20 and 22 is completed.

In this structure 10 of connecting the panel-side connectors to the body-side connectors, merely by mounting the reinforce 12 on the vehicle body, the panel-side connectors 16 and 17 can be connected to the body-side connectors 24 and 26, respectively.

Therefore, the time and labor for connecting the panel-side connectors 16 and 17 to the body-side connectors 24 and 26 are saved, and the operation for mounting the reinforce 12 on the vehicle body portions 20 and 22 can be easily effected.

At least either the panel-side connectors 16 and 17 or the body-side connectors 24 and 26 are of the automatic self-aligning type having such a configuration as disclosed in Japanese Patent Publications Nos. 10-92522A and 10-129299A.

Therefore, when mounting the reinforce 12 on the vehicle body portions 20 and 22, the panel-side connectors 16 and 17 can be more positively connected to the body-side connectors 24 and 26, respectively.

Therefore, the time and labor for connecting the panel-side connectors 16 and 17 respectively to the body-side connectors 24 and 26 are saved, and the operation for mounting the reinforce 12 on the vehicle body portions 20 and 22 can be carried out more easily.

In the above embodiment, although the reinforce 12 has the H-shaped cross-section, the reinforce 12 is not limited to this shape, but can be formed, for example, into a roughly U-shaped cross-section.

The present invention is not limited to the above embodiment, but suitable modifications and improvements can be made, and the material, shape, dimensions, number, mounting positions, thickness and so on of each of the instrument panel, the reinforce 12, the fixing brackets 23 and 25 and so on are arbitrary, and are not limited in so far as the invention can be achieved.

What is claimed is:

1. An electric connection structure in a vehicle body, comprising:

a reinforce including a first longitudinal end portion anti a second longitudinal end portion, on which an instrument panel of a vehicle is attached, wherein a wire harness is installed along the reinforce and is connecter;

a first electric junction housing, wherein the first electric junction housing includes a bracket for fixing the first electric junction housing on the vehicle body, and wherein the first electric junction housing retains the reinforce on the vehicle body;

the first connector, provided on one of the longitudinal end portions of the reinforce, the first connector electrically connected to electric equipments provided with the instrument panel; and a second connector, included in the first electrical junction housing, wherein electric connection is effected between the first connector and the second connector;

wherein the reinforce is formed with a flange portion; and wherein the bracket of the first electrical junction housing is formed with a groove which receives the flange portion when the reinforce is fixed on the vehicle body.

2. The electric connection structure as set forth in claim 1, wherein the first connector and the second connector are self-aligning.

3. The electric connection structure as set forth in claim 1, further comprising:

a second electric junction housing provided in the vehicle body, wherein the second electric junction housing includes a bracket for fixing the second electric junction housing on the vehicle body, and wherein the second electrical junction housing retains the reinforce on the vehicle body; and a third connector, provided on the other of the longitudinal end portions of the reinforce, the third connector electrically connected to electric equipments provided with the instrument panel; and a fourth connector, included in the second electrical junction housing, wherein electric connection is effected between the third connector and the fourth connector when the reinforce is fixed on the vehicle body.

4. The electric connection structure as set forth in claim 3, wherein the third connector and the forth connector are self-aligning.

5. The electrical connection structure as set forth in claim 3, wherein the wire harness is connected to the third connector.

* * * * *